United States Patent [19]

Hall

[11] 4,384,928

[45] May 24, 1983

[54] ANODE FOR OXYGEN EVOLUTION

[75] Inventor: Dale E. Hall, Monroe, N.Y.

[73] Assignee: MPD Technology Corporation, Wyckoff, N.J.

[21] Appl. No.: 305,771

[22] Filed: Sep. 28, 1981

Related U.S. Application Data

[63] Continuation-in-part of Ser. No. 209,514, Nov. 24, 1980.

[51] Int. Cl.[3] ..... C25B 1/00; C25B 11/04

[52] U.S. Cl. ..... 204/38 B; 204/96; 204/129; 204/290 R; 204/293

[58] Field of Search ..... 204/96, 38 B, 290 R, 204/129, 293

[56] References Cited

U.S. PATENT DOCUMENTS

| | | | |
|---|---|---|---|
| 3,310,870 | 3/1967 | Parikh et al. | 29/420.5 |
| 3,316,625 | 5/1967 | Flint et al. | 29/420.5 |
| 3,989,863 | 11/1976 | Jackson et al. | 427/367 |
| 4,184,930 | 1/1980 | Appleby | 204/96 |
| 4,200,515 | 4/1980 | Hall et al. | 204/290 R |

FOREIGN PATENT DOCUMENTS

| | | |
|---|---|---|
| 921263 | 2/1973 | Canada . |
| 1062580 | 3/1967 | United Kingdom . |

OTHER PUBLICATIONS

Abstract of U.K. Patent No. 749,143, British Abridgements, Group XXXVI, Ser. 740,001–760,000, pp. 185–186, 1958.

E. J. McHenry, "Electrochemical Precipitation of Ni-$(OH)_2$ Into Porous Electrodes", Electrochemical Technology, 5, pp. 275–279, 1967.

A. J. Salkind and U. Falk, "Alkaline Storage Batteries", John Wiley & Sons, Inc., 1969–Book.

A. J. Appleby, et al., "High Efficiency Water Electrolysis in Alkaline Solution", Int. J. Hydrogen Energy, 3, pp. 21–37, 1978.

P. W. Lu, et al., "Electrochemical–Ellipsometric Studies of Oxide Film Formed on Nickel During Oxygen Evolution", J. Electrochem. Soc., 125, pp. 1416–1422, 1978.

D. E. Hall, "Electrodes for Alkaline Water Electrolysis", J. Electrochem. Soc., 128, pp. 740–746, 1981.

*Primary Examiner*—R. L. Andrews

*Attorney, Agent, or Firm*—Raymond J. Kenny; Miriam W. Leff

[57] ABSTRACT

An anode for oxygen evolution in alkaline electrolyte is provided. The electrode comprises an electrically conductive support surface having a porous metal layer adhered to at least part of it and having $Ni(OH)_2$ molecules deposited upon the surface and within the pores of the porous metal layer. A process for producing this anode is also provided.

27 Claims, No Drawings

ANODE FOR OXYGEN EVOLUTION

This application is a continuation-in-part of U.S. application Ser. No. 209,514, filed Nov. 24, 1980.

FIELD OF THE INVENTION

The present invention is concerned with anodes for oxygen evolution in alkaline electrolytes and, in particular, for use in water electrolysis.

BACKGROUND OF THE INVENTION

The art of oxygen evolution is an old one and is highly developed. Nickel has been and remains the preferred choice for alkaline electrolysis anodes because it has the best efficiency and corrosion resistance characteristics among the non-precious metals. It is known that during operation the nickel anode surface is converted completely to various nickel oxide and hydroxide species on which the oxygen is actively evolved. Researchers have determined that the chemical nature of the first few molecular layers of the oxide film is of major importance in determining the efficiency of the oxygen evolution reaction. Other researchers have found that the species beta-NiOOH is particularly active. The active nickel surface species is referred to herein as nickel oxyhydroxide.

The present invention is directed towards increasing the amount of nickel oxyhydroxide at the anode surface above that which would normally be formed directly by anodization of the nickel surface.

OBJECT

It is an object of the present invention to provide a novel electrode for oxygen evolution.

It is another object of the present invention to provide a process for the production of this anode.

This and other objects will become apparent from the following descriptions.

SUMMARY OF THE INVENTION

The present invention contemplates the use of an anode for oxygen evolution in alkaline electrolytes. The anode comprises an electrically conductive surface support which has a porous metal layer coated onto at least a portion of it. Onto the coated electrically conductive support surface are deposited molecules of $Ni(OH)_2$. These molecules are deposited upon the surface and within the pores of the porous metal layer. It is believed that when this anode is used in aqueous alkaline electrolyte for an oxygen evolution process, the $Ni(OH)_2$ is converted to the highly active nickel oxyhydroxide.

DETAILED DESCRIPTION OF THE INVENTION

The substrate of the electrode of the present invention is electrically conductive and has a surface which is also corrosion resistant in the environment of use. For example, stainless steel, nickel or nickel alloys may be used as the surface material for alkaline electrolytes. The surface material may be coated or cladded or developed on more conductive less expensive materials. The core material can be, for example, copper or aluminum. Examples of suitable composite substrates are nickel plated on steel and stainless steel clad on copper. Mild steel may be used as the surface material if it is converted before use of the electrode to a corrosion resistant alloy, e.g. by diffusion with nickel to form a nickel-iron alloy layer. A porous metal layer is deposited on the support surface of the substrate.

The porous metal layers have been made with porous nickel or nickel-iron alloy layers about 15 to 275 micrometers thick, with the preferred and advantageous range of thickness being 25 to 125 micrometers. These porous layers are about 50% of theoretical density and may be sintered at temperatures of about 750° C. to about 1000° C. in an inert or reducing atmosphere, for example, for at least about 10 minutes at 750° C. and at least 2–3 minutes at 1000° C. so as to exhibit a combination of strength and electrochemical characteristics. Strength in the porous layers is necessary in order to resist cavitation forces existing at water electrolyzer anode surfaces during high current density operation. Porosity is necessary in order that the overpotential remain as low as possible. An optimum combination of these characteristics is obtained by sintering INCO TM Type 123 nickel powder (a product of Inco Ltd. made by thermal decomposition of nickel carbonyl, the manufacture of which is generally described in one or more of: Canadian Pat. No. 921,263, U.K. Pat. No. 1,062,580, U.K. Pat. No. 749,143) onto steel approximately at the time when spiky protrusions on the individual powder particles disappear with the angularity of the individual powder particles still evident under microscopic examination. This state of sintering is achieved with INCO Type 123 nickel powder on steel usually within a few minutes after meeting the minimum sintering times set forth herein. A different grade of nickel powder produced by decomposition of nickel carbonyl and sold by Inco Ltd. as INCO Type 287 or 255 nickel powder, nickel-iron powder made by co-decomposition of nickel carbonyl and iron carbonyl and flake made by milling INCO Type 123 nickel powder, may be satisfactory for manufacture of anodes of the present invention.

The porous layer on the anode support surface may consist of a metallurgically bonded mass of powder the individual particles of which are in the size range (or equivalent spherical size range) of about 2 to about 30 micrometers and preferably 2–10 micrometers. The preferred layers are of the order of about 10 to 20 particles thick and contain tortuous paths of varying dimensions principally dependent upon the size and degree of packing of the individual powder particles.

As indicated above, the porous metal layer support structures can be formed on any electrically conducting material which is corrosion resistant in the oxidizing alkaline environment, e.g. stainless steel or nickel and nickel alloys. The coating is formed using slurry coating compositions and techniques as set out in one or more of Parikh et al, U.S. Pat. No. 3,310,870; Flint et al, U.S. Pat. No. 3,316,625 and Jackson et al, U.S. Pat. No. 3,989,863, as well as, by other slurry coating techniques. The aforesaid U.S. patents are incorporated herein by reference. Prior to coating with metal powder, the substrate metal surface is advantageously roughened such as by sandblasting, grit blasting and the like. After coating the substrate is dried (if a liquid carrier of the metal powder has been used) and may be sintered as disclosed hereinbefore to metallurgically bond particles one to another and to the base by diffusion. Electrostatic spray, cloud and fluid bed processes and any other means whereby a thin layer of fine metal powder can be applied in a controllable, non-mechanically packed manner to a metal substrate can also be used to prepare the porous metal coating.

During sintering, it is necessary to maintain a reducing or inert atmosphere in the vicinity of the sintering layer in order to avoid thermal oxidation.

A $Ni(OH)_2$ layer is deposited on the porous metal coating. It may be deposited chemically, physically or electrochemically. In general, the $Ni(OH)_2$ level may be only a small but effective amount for lowering the $O_2$ potential, and may range up to an amount as high as possible without causing problems, such as plugging of the pores of the porous metal surface. For example, the $Ni(OH)_2$ loading may range up to about 10 mg/cm$^2$. Typically, the $Ni(OH)_2$ loading is about 1 mg/cm$^2$ up to about 6 mg/cm$^2$. Conversion of the $Ni(OH)_2$ to the active form can be achieved prior to use or in-situ. In a preferred method the $Ni(OH)_2$ is deposited electrochemically in a one-step electrochemical impregnation process and the active nickel oxyhydroxide is developed anodically. F. J. McHenry, in a 1967 article which appeared in Elechemical Technology 5, 275, described an electrochemical precipitation process for impregnating porous nickel battery electrodes. In this process, a porous nickel electrode is cathodized at constant current density in an aqueous nickel nitrate electrolyte.

It has now been discovered that electrochemical impregnation of $Ni(OH)_2$—as the precurser of the active surface material on the porous metal surface described above—produced an anode for oxygen evolution having improved characteristics. The process was found to offer several advantages for impregnating the porous metal layer on support surface anodes. First, it is possible to coat the pores continuously to the degree desired, e.g. until the optimum $Ni(OH)_2$ loading range is obtained. The cathodization electrolyte contains nickel ions which continue to diffuse into the metal layer until the pores are physically plugged, permitting high loading with only one cycle. Thus, process time and the number of operations required are greatly reduced. Secondly, it was found that the $Ni(OH)_2$ loading increased linearly with the quantity of charge passed until saturation was approached, so that the $Ni(OH)_2$ loading can be controlled easily. Thirdly, in this process while the electrode is maintained at a cathodic potential during most of its exposure to the acidic nitrate solution, the solution actually in contact with the substrate is alkaline rather than acid. Thus, corrosion is reduced considerably compared with alternative processes. Fourthly, there are fewer instances in this process of exposure of the moist electrodes to air. If the substrate is made of steel, no rust staining of the steel substrate occurs.

The concentrations of nickel nitrate solution range from about 0.05 molar to 4 molar. It is preferred that the lower concentrations be utilized because a better product results. The preferred range is about 0.1 to about 0.3 moles per liter.

The temperature at which the bath is maintained can range from about room temperature to about 60° C. The cathode current density for impregnation may range from about 1 mA/cm$^2$ to about 200 mA/cm$^2$. The cathode current density required is dependent upon the concentration of the nickel nitrate in the solution. The higher the concentration, the higher the current required. The applicant herein has found that when 0.2 M nickel nitrate solution is used, 7 mA/cm$^2$ provides good results and when 4 M nickel nitrate is used, 170 mA/cm$^2$ provides good results. The time required for the deposition for the $Ni(OH)_2$ upon the coated surface is dependent on the current density utilized and the amount of $Ni(OH)_2$ desired. As the following examples will indicate, there is an optimum amount of $Ni(OH)_2$ per unit area of electrode surface, as measured by the greatest reductions in oxygen evolution overpotential. Care must be taken that the amount of $Ni(OH)_2$ impregnated is not so great as to fill in the pores of the porous metal layer.

To give those skilled in the art a better understanding of this invention, the following illustrative examples are given.

EXAMPLE 1

Anode panels were made by coating grit blasted mild steel (1008 grade) substrates with INCO Type 123 nickel powder dispersed in a polysilicate aqueous vehicle. The panels were dried and then sintered at 870° C. for 10 minutes in a cracked ammonia atmosphere. Of the 8 anodes made, 6 were impregnated with nickel hydroxide as disclosed in Table I. The unimpregnated anodes are of the type disclosed in U.S. Pat. No., 4,200,515. The anodes were tested in 80° C. aqueous KOH (30% by weight) electrolyte for approximately 6 hours at 200 mA/cm$^2$. Overpotential is measured against the saturated calomel electrode (SCE) using a standard method. Details of the testing and results thereof are set forth in Table II.

Table I shows that there is a linear relationship between the amount of loading of $Ni(OH)_2$ on the anode and the time constant current was passed in the nickel-nitrate bath. Table II indicates that the greater the amount of $Ni(OH)_2$ present on the anode up to a loading of 4.66 mg/cm$^2$, the more efficient the anode was in testing.

TABLE I

| Electrode | Time, sec | Coul/cm$^2$ passed | Load $Ni(OH)_2$, mg/cm$^2$ |
|---|---|---|---|
| 1 | 0 | 0 | 0 |
| 2 | 0 | 0 | 0 |
| 3 | 120 | 0.84 | 0.55 |
| 4 | 180 | 1.26 | 0.89 |
| 5 | 300 | 2.10 | 1.55 |
| 6 | 420 | 2.94 | 2.29 |
| 7 | 540 | 3.78 | 3.15 |
| 8 | 840 | 5.88 | 4.66 |

Impregnation: In an aqueous solution of 0.2 M $Ni(NO_3)_2$, T = 50° C.
Cathode current density = 7 mA/cm$^2$
Nickel anode used

TABLE II

| | TEST $O_2$ Evolution Overpotential, mV at (mA/cm$^2$) | | |
|---|---|---|---|
| Electrode | 10 | 50 | 200 |
| 1 | 177 | 200 | 219 |
| 2 | 161 | 183 | 202 |
| 3 | 147 | 168 | 185 |
| 4 | 143 | 161 | 176 |
| 5 | 148 | 168 | 185 |
| 6 | 129 | 147 | 163 |
| 7 | 135 | 154 | 171 |
| 8 | 114 | 132 | 146 |

EXAMPLE 2

Mild steel sheets were used as substrate material for electrodes. The substrates were provided with a porous high surface area coating using INCO Type 123 nickel powder in a polysilicate-base paint as described in Example 1. The nickel-coated steel sheets were then impregnated with $Ni(OH)_2$ by a "two-step" process. First the coated substrates were soaked in an electrolyte solution containing 250 g/L of nickel as the nitrate salt and 1% by volume nitric acid. The temperature of the soak solution was 50° C., and the soak time was varied in one set of experiments, but was otherwise 10–15 minutes. The nitrate soak filled the electrode coating pores with the highly concentrated $Ni(NO_3)_2$ solution. The electrodes were then lifted from the soaking tank and excess electrolyte was allowed to drain from their surfaces. They were then immediately immersed in 20 weight % KOH solution at 70° C. and cathodically polarized for 20 minutes at a current density of 80 $mA/cm^2$, to electrochmically precipitate $Ni(OH)_2$ within the pores of the coating. The electrodes were then washed thoroughly with de-ionized water at 60°–80° C. for 1–4 hours and oven dried at 80° C. To increase $Ni(OH)_2$ loading, the entire sequence was repeated as many as four times. Catalyst loading was determined by weight gain.

The impregnated sheet electrodes were tested as anodes in 30 weight % KOH at 80° C. The tests were carried out galvanostatically, with electrodes operated at a current density of 200 $mA/cm^2$ for about 6 hours. Some anodes were also operated for 500 hours at 100 $mA/cm^2$ in the same environment. Experimental overpotential measurements were made vs. a commerical SCE using a standard method.

In electrochemical tests at a current density of 200 $mA/cm^2$, oxygen evolution overpotentials were reduced 30–55 mV compared to anodes similarly prepared except that they were not impregnated. Tests at 100 $mA/cm^2$ showed no loss of catalytic activity during a 500-hour test period.

Tests evaluating oxygen evolution overpotential vs. $Ni(OH)_2$ loading indicated that there was little or no benefit in increasing the loading from 2.3 to 5.3 $mg/cm^2$. One possible explanation for this is that the higher loadings produced plugged coating pores or excessive surface buildup, thus blocking portions of the anode from participating in the electrode reaction. The problem of surface buildup was, in fact, one of the difficulties encountered with the two-step impregnation technique of this example.

The morphology of the $Ni(OH)_2$ prepared in accordance with this example was not completely satisfactory. A reasonably uniform distribution of catalyst throughout the porous coating was desired, without surface pore blockage, which interferes with electrolyte penetration and gas evolution. However, some buildup of $Ni(OH)_2$ on at least part of the face of the porous coating was usually observed. On some electrodes, this was extensive enough to be visible as a dense green layer over parts of the electrode surface. Nickel hydroxide loading could not be easily controlled through changes in process variables. In successive impregnation cycles, it was not possible to predict the $Ni(OH)_2$ pick-up accurately. It is possible that part of the difficulty in getting reproducible loadings was due to concurrent corrosion of the electrode itself in the acidic nitrate electrolyte. The initial electrode soak in the acidic $Ni(NO_3)_2$ solution with no applied potential produced slight but noticeable corrosion of the steel substrates, which produced stains on the impregnated electrodes. Even with nickel substrates, it is likely that some corrosion of the substrate and the coating occurred.

The effect of the soak time, i.e., the time the electrodes were allowed to wet in the $Ni(NO_3)_2$ solution, was investigated. Only a slight reduction in oxygen evolution overpotential was obtained by extending the soak time beyond 3 minutes, the shortest time used, indicating that the nickel nitrate solution effectively flooded the coating pores in that time. The shorter soak time also reduced electrode corrosion; still shorter soak times could probably be used, but this was not pursued after the more advantageous impregnation method of Examples 1 and 3 was found. Thus, despite the reductions in anode overpotentials which were obtained, the difficulties in the impregnation process itself made this method less satisfactory than the impregnation method of Examples 1 and 3.

EXAMPLE 3

Mild steel screens were used as substrates in the preparation of anodes. The screen samples, each measuring 2.7 cm×5.2 cm, were coated with a polysilicate paint containing INCO Type 123 nickel powder essentially as described in Example 1. The nickel-coated screens were impregnated with $Ni(OH)_2$.

All impregnations were done with 0.2 M $Ni(NO_3)_2$ electrolyte at 50° C. Screens were soaked for one minute in the electrolyte before cathodic current was applied. Two oversize nickel anodes were used, one on each side of the cathode and plane-parallel to it. The electrodes were then water-rinsed and dried following impregnation.

A cathodic current density of 12 $mA/cm^2$, based on the geometric dimensions of the screens, was used to precipitate $Ni(OH)_2$. This current density was calculated by multiplying that used for sheet electrodes in Example 1, i.e. 7 $mA/cm^2$, by a 1.7 area correction factor relating the actual surface area of the screen to its geometric area.

Impregnation of anode screens was carried out using successive increases in the amount of time that current was applied. Weight gains, i.e. $Ni(OH)_2$ loadings, showing the $Ni(OH)_2$ loading obtained per square centimeter of geometric area were determined by weight difference measurements.

Electrochemical tests were carried out essentially as described in Example 2, and the morphologies of $Ni(OH)_2$ deposits in the anode screen coatings and their variation with $Ni(OH)_2$ loading were investigated by scanning electron microscopy.

Evaluation of the results of the electrochemical tests on the anode screens showed that the oxygen evolution overpotentials were considerably lower than with similar unimpregnated anodes. The anode overpotentials showed an initial sharp drop at relatively low $Ni(OH)_2$ loadings. This was followed by an optimum range of $Ni(OH)_2$ loadings (about 1–4 $mg/cm^2$) in which the overpotential was relatively constant and about 40–45 mV below that of uncatalyzed anodes at an anode current density of 200 $mA/cm^2$ (based on geometric area). At higher $Ni(OH)_2$ loadings, the anode overpotentials increased. This may be caused by pore plugging.

EXAMPLE 4

Mild steel sheet was used as substrate material in the preparation of anodes. The steel sheet was coated with a porous nickel coating using a method essentially as described in Example 1. The nickel-coated sheet was immersed in aqueous nickel nitrate solution and allowed to wet thoroughly for 1–2 minutes while the electrolyte was stirred. Stirring was then discontinued and the electrodes were cathodically polarized to precipitate $Ni(OH)_2$. Two sets of conditions were used.

1. $Ni(NO_3)_2$ concentration=0.2 M, T=50° C. cathode current density=7 mA/cm$^2$.
2. $Ni(NO_3)_2$ concentration=4 M, T=25° C. cathode current density=170 mA/cm$^2$.

Cathodization times were varied, producing different $Ni(OH)_2$ loadings which were determined by weight gain. These times varied from 2 minutes to 25 minutes for conditions 1, and from 15 seconds to 5 minutes for conditions 2. The electrodes were then water-rinsed and dried.

The one-step method of this example overcomes practical difficulties associated with the multi-step method of Example 2. For example, in the multi-step method, the amount of nickel which can be precipitated as $Ni(OH)_2$ is limited to what has been carried within the coating pores from the soak solution. Thus, more than one impregnation cycle is necessary to achieve optimum loading. In the one-step process, however, the cathodization electrolyte contains nickel ions which continue to diffuse into the coating until the pores are physically plugged, permitting any desired loading with only one cycle. Thus, process time and the number of operations required are reduced. Also, unsatisfactory surface buildup which was observed using the multi-step impregnation was not observed at the comparable $Ni(OH)_2$ loadings when the one-step method of this example was used. Furthermore, in the one-step technique, the electrode is maintained at a cathodic potential during most of its exposure to the acidic nitrate solution, the solution actually in contact with the substrate being alkaline rather than acid. Thus, corrosion should be reduced considerably compared to the multi-step method. In addition, there are fewer instances in the one-step method of impregnation of exposure of moist electrodes to air. In practice, no rust staining of steel substrates occurred. A still further advantage of the one-step method is that the $Ni(OH)_2$ loading increased linearly with the quantity of charge passed until saturation loading was approached, as discussed in Example 5.

Electrochemical tests were carried out essentially as described in Example 2, and the morphologies of $Ni(OH)_2$ deposits in the anode screen coatings and their variation with $Ni(OH)_2$ loading were investigated by scanning electron microscopy.

Evaluation of the results of the electrochemical tests on the anode sheet substrates showed that the oxygen evolution overpotentials were considerably lower than with similar unimpregnated anodes. Also, the overpotential decreased rapidly at low $Ni(OH)_2$ loading and then remained relatively constant up to 5 mg/cm$^2$ loading. In the optimum loading range the overpotential reduction was about 60 mV at a current density of 200 mA/cm$^2$.

Scanning electron microscopy at the conclusion of electrochemical tests showed no evidence of degradation of the $Ni(OH)_2$ deposits or of the porous nickel coatings themselves. Similarly, $Ni(OH)_2$ anodes operated for 500 hours maintained stable potentials after an initial potential rise.

Scanning electron micrographs of the $Ni(OH)_2$ deposits produced by the one-step method show that they are compact rather than open-structured or dendritic, and it appears that the interior surfaces of the porous coatings are covered with $Ni(OH)_2$. To produce such coatings, however, the $Ni(OH)_2$ should be kept at loadings below about 6 mg/cm$^2$, and preferably the coatings should be applied from an electrolyte having a suitable concentration of $Ni(NO_3)$, e.g. not more than about 4 M $Ni(NO_3)_2$.

With higher $Ni(OH)_2$ loadings, the $Ni(OH)_2$ deposit begins to plug the nickel coating pores and the deposit displays a cracked "mud-flat" appearance. This progression in deposit morphology with increasing $Ni(OH)_2$ loading was observed with both sheet and screen anodes. However, the onset of pore plugging and cracked deposits did not always occur at the same loading. In general, in the present invention it was found that best results with high surface area nickel electrode coatings were obtained at a low current density (7 mA/cm$^2$) and $Ni(NO_3)_2$ concentration (0.2 M). Acceptable results were also obtained with 4.0 M $Ni(NO_3)_2$ and a current density of 170 mA/cm$^2$, although some surface buildup of $Ni(OH)_2$ occurred under those conditions. In addition, the high current density and nickel concentration of the latter conditions, coupled with the low $Ni(OH)_2$ loadings desired and the thinness of the nickel electrode coatings, resulted in optimum process times which were perhaps undesirably short (~30 seconds) for effective control in a large batch-processing operation. For these reasons, most one-step impregnations were carried out at the lower cathode current density and electrolyte concentration.

EXAMPLE 5

It is the purpose of this example to compare the present anodes, which are suitable for the evolution of gas, e.g. the evolution of $O_2$, with porous plaques used for battery electrodes such as those described in the aforementioned article by McHenry.

As noted previously, anodes of the present invention are coated with a high surface area metal coating which is impregnated with $Ni(OH)_2$. Contrastingly, in a battery, the battery plaque is substantially more porous and the plaque is generally thicker than the sintered metal coatings used in the anodes of the present invention. The McHenry plaque is composed of sintered nickel about 710 μm in thickness and it is about 85% porous, with the pores being accessible from opposing surfaces.

It is noted that the purpose as well as the structure of the present anodes differ from the McHenry battery plaques. In the present invention, the anodes function as gas evolving devices and the nickel oxyhydride at the surface serves as an electrocatalyst. Consequently, the active material need not be thick. It is desirable to get maximum coverage of the surface pores so as to maximize the available catalyst sites. In battery plaques, however, the $Ni(OH)_2$ is the discharged form of the active mass, the reaction of which is used to produce current. Hence, the more $Ni(OH)_2$ that can be used, without causing volume change or other problems, the better.

The differences in purpose and structure are reflected in the behavior of the materials.

The porous nickel coatings of the present invention were about 50% dense. Using a sintered metal coating weight of 65 mg/cm$^2$, the approximate average of the anode screens, described in Example 3, complete packing of the coating pores would produce a loading of 30 mg/cm$^2$. However, plugging of coating surface pores with $Ni(OH)_2$ occurred at considerably lower loadings, about 6 mg/cm$^2$ or 20% of the theoretical maximum value. This indicates that the coating interior received a much lighter loading than the surface.

Using porosity and thickness specifications reported by McHenry for the porous nickel plaques, a maximum theoretical $Ni(OH)_2$ loading of 250 mg/cm$^2$ was calculated for those electrodes. However, McHenry found that saturation loading (i.e., passing further charge produced little or no weight gain) occurred at a loading of about 80 mg/cm$^2$, or roughly 30% of the theoretical maximum. The higher percentage loading obtained by McHenry was due to the greater porosity and average pore size of the nickel plaques, compared to the porous nickel-coated electrodes of the present invention. Other published data indicate that even higher $Ni(OH)_2$ loadings, e.g., up to about 50% of the theoretical maximum loadings, are sometimes used in porous nickel battery plaques.

Important differences in the behavior of the two types of electrodes as a function of $Ni(OH)_2$ loading were evident. McHenry found that the capacities of impregnated battery plaques increased until saturation loading was reached. In addition, McHenry reported that $Ni(OH)_2$ deposited in the initial phase of impregnation was less efficient than that deposited subsequently. In the present invention, however, the opposite behavior was found. The first 2 mg/cm$^2$ of $Ni(OH)_2$, about 6% of the theoretical maximum, produced almost all of the improvement in the electrocatalytic activity of the porous nickel-coated screen anodes, and there is no advantage in having more than about 15% of the theoretical maximum. Thus, the impregnation requirements and electrochemical behavior of the impregnated $Ni(OH)_2$ in battery electrodes and oxygen evolution anodes are distinctly different.

EXAMPLE 6

Sheet-type cathodes for hydrogen evolution were $Ni(OH)_2$-impregnated using the method essentially as described in Example 2 (i.e. the multi-step impregnation method on the high surface area coating). Hydrogen evolution overpotential reductions of up to 120 mV were obtained at a current density of 200 mA/cm$^2$. As with the anodes, cathodes showed minimum overpotentials at intermediate $Ni(OH)_2$ loadings. The optimum result was obtained at a loading of 2.7 mg/cm$^2$ after two impregnation cycles.

Sheet-type cathodes prepared essentially as described in Example 4 (i.e. using the one-step impregnation method on a high surface area coating) showed a maximum hydrogen evolution overpotential reduction of about 100 mV at a current density of 200 mA/cm$^2$. This was achieved by impregnation in the 4 M $Ni(NO_3)_2$ electrolyte solution.

While significant reductions in $H_2$ evolution overpotential can be obtained with the present cathodes compared to known nickel cathodes, there are other types of cathodes known which may perform better for hydrogen evolution. The example illustrates that the electrodes of the present invention may also be used for gas, e.g. $H_2$, evolution in alkaline solution. Thus, for example, the electrodes of this invention may be used for both anodes and cathodes for the electrolysis of water.

EXAMPLE 7

Porous nickel coatings were applied to woven nickel screen substrates from a polysilicate-based paint and the coated substrate sintered, essentially as described in Example 1. Screen A was coated on one side only; screen B was coated on both sides. The porous nickel-coated screens A and B were then cut in half. The as-sintered anodes are of the type disclosed in the aforementioned U.S. Pat. No. 4,200,515. One half of each screen was impregnated using the one-step process of this invention as described in Example 3, using a 0.2 M nickel nitrate solution at 50° C. The current density used in the impregnation was 24 mA/cm$^2$ based on the geometric areas of the screens. Current was applied for 200 seconds. The resulting $Ni(OH)_2$ loadings, 7.5 mg/cm$^2$ screen A and 9.6 mg/cm$^2$ for screen B, are believed to be substantially higher than necessary for the optimum combination of overpotential reduction and process and materials cost.

The anodes, both impregnated and unimpregnated, were operated for about 6 hours at 200 mA/cm$^2$ in 30 weight % KOH (aqueous) at 80° C. The following overpotentials were measured.

| Anode | Condition | Overpotential at 200 mA/cm$^2$ (volts) |
|---|---|---|
| A | As-sintered | 0.38 |
| A | Impregnated | 0.27 |
| B | As-sintered | 0.38 |
| B | Impregnated | 0.27 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process for producing an anode for oxygen evoution in an alkaline electrolyte wherein the process comprises
   a. coating an adherent, porous layer comprising nickel upon an electrically conductive support surface, said porous layer having a thickness of about 25 to about 275 micrometers and having a density of about 50%,
   b. placing the coated support surface into an aqueous nickel nitrate solution, and
   c. applying cathodic current to coated support surface, for a time sufficient to coat $Ni(OH)_2$ molecules upon the surface and pores of the porous layer and to provide a $Ni(OH)_2$ loading of up to about 10 mg/cm$^2$ of support surface.

2. The process of claim 1, wherein the cathodic current is applied while the coated substrate is immersed in the nickel nitrate solution.

3. The process of claim 1, wherein the anode is then washed in water, and then dried.

4. The process of claim 1, wherein the porous metal layer upon the support surface is sintered nickel upon a substrate material selected from the group consisting of mild steel, nickel, a nickel alloy, and stainless steel.

5. The process of claim 2, wherein the nickel nitrate solution is about 0.05 to about 4 molar.

6. The process of claim 5, wherein the solution is about 0.1 to about 0.3 molar.

7. The process of claim 1, wherein the cathodic current density is about 1 up to about 200 mA/cm$^2$.

8. The process of claim 1, wherein the cathodic current is about 7 mA/cm$^2$ and the nickel nitrate solution is about 0.2 molar.

9. A process for the electrolytic production of oxygen comprising passing an electric current through an alkaline solution containing therein an anode and cathode, wherein the anode prior to anodic actions comprises a. an electrically conductive support surface, b. a porous layer comprising nickel adhered to at least part of said support surface, said porous layer having a thickness of about 25 to about 275 micrometers and a density of about 50%, and c. $Ni(OH)_2$ deposited upon the surface and within the pores of the porous layer, the loading of said $Ni(OH)_2$ being a small but effective amount to reduce the overpotential for $O_2$ evolution ranging up to about 10 mg/cm$^2$ of support surface.

10. The process of claim 9, wherein the $Ni(OH)_2$ loading on the porous layer is up to about 20% of theoretical maximum value.

11. The process of claim 10, wherein the $Ni(OH)_2$ loading is about 6% to about 15% of theoretical maximum value.

12. The process of claim 9, wherein the cathode and anode are of substantially the same compositions.

13. An anode for oxygen evolution in alkaline electrolyte, said anode prior to anodic actions comprising a. an electrically conductive support surface, b. a porous layer comprising nickel adhered to at least part of said support surface, said porous layer being about 50% dense and having a thickness of about 25 to about 275 micrometers, and c. $Ni(OH)_2$ deposited upon the surface and within the pores of the porous layer, the loading of said $Ni(OH)_2$ being a small but effective amount to reduce the overpotential for $O_2$ evolution ranging up to about 10 mg/cm$^2$ of support surface, said porous layer bearing said deposit having a porosity of less than about 50%.

14. An anode of claim 13, wherein the support surface is steel, nickel or nickel alloy.

15. An anode of claim 13, wherein the support surface is deposited on a substrate.

16. The anode of claim 15, wherein the substrate is steel and the support surface is nickel plated on said steel substrate.

17. The anode of claim 13, wherein the porous layer comprises nickel or a nickel-iron alloy.

18. An anode of claim 13, wherein the $Ni(OH)_2$ is substantially converted to nickel oxyhydroxide by placing into an aqueous alkaline solution and applying anodic current.

19. An anode of claim 13, wherein the porous layer deposited on the support surface has a thickness of up to about 125 micrometers.

20. An anode of claim 17, wherein the porous layer is deposited as a powder in an aqueous medium.

21. An anode of claim 13, wherein the $Ni(OH)_2$ loading on the porous layer is about 1 to about 6 mg/cm$^2$.

22. An anode of claim 13, wherein the $Ni(OH)_2$ loading on the porous layer is greater than about 1 mg/cm$^2$.

23. An anode of claim 13, wherein the $Ni(OH)_2$ loading on the porous layer is up to about 20% of the theoretical maximum value.

24. An anode of claim 13, wherein the $Ni(OH)_2$ loading on the porous layer is about 6% to about 15% of the theoretical maximum value.

25. An electrode for gas evolution in alkaline electrolytes, said electrode comprising a. an electrically conductive support surface, b. a porous layer comprising nickel adhered to at least part of said support surface, said porous layer being about 50% dense and having a thickness of about 25 to about 275 micrometers, and c. $Ni(OH)_2$ deposited upon the surface and within the pores of the porous layer, the loading of said $Ni(OH)_2$ deposit being less than about 10 mg/cm$^2$ of support surface.

26. An electrode of claim 25, wherein said electrode is used as an anode.

27. An electrode of claim 25, wherein said electrode is used as a cathode.

* * * * *